US007256669B2

(12) United States Patent
Morrison, Jr. et al.

(10) Patent No.: US 7,256,669 B2
(45) Date of Patent: Aug. 14, 2007

(54) METHOD OF PREPARING ELECTRICAL CONTACTS USED IN SWITCHES

(75) Inventors: Richard H. Morrison, Jr., Taunton, MA (US); Nicol E. McGruer, Dover, MA (US); Jeffrey A. Hopwood, Needham, MA (US)

(73) Assignee: Northeastern University, Boston, MA (US)

( * ) Notice: Subject to any disclaimer, the term of this patent is extended or adjusted under 35 U.S.C. 154(b) by 1023 days.

(21) Appl. No.: 09/844,251

(22) Filed: Apr. 27, 2001

(65) Prior Publication Data

US 2002/0088112 A1 Jul. 11, 2002

Related U.S. Application Data

(60) Provisional application No. 60/200,306, filed on Apr. 28, 2000.

(51) Int. Cl.
*H01H 51/22* (2006.01)

(52) U.S. Cl. ..... 335/78; 200/181

(58) Field of Classification Search ..... 335/58, 335/78; 200/181

See application file for complete search history.

(56) References Cited

U.S. PATENT DOCUMENTS 4,617,542 A * 10/1986 Lutz et al. ..... 335/196
4,755,706 A * 7/1988 Harnden et al. ..... 310/332
5,479,042 A 12/1995 James et al. ..... 257/415
5,620,933 A 4/1997 James et al. ..... 216/2
5,627,396 A 5/1997 James et al. ..... 257/415
5,638,946 A * 6/1997 Zavracky ..... 200/181
5,959,338 A * 9/1999 Youngner et al. ..... 257/419
6,142,007 A * 11/2000 Yuze et al. ..... 73/11.04
6,300,152 B1 * 10/2001 Kim ..... 438/30
6,396,371 B2 * 5/2002 Streeter et al. ..... 335/78
6,407,004 B1 * 6/2002 Kimura et al. ..... 438/720
6,483,395 B2 * 11/2002 Kasai et al. ..... 333/105
6,512,322 B1 * 1/2003 Fong et al. ..... 310/328
6,544,834 B1 * 4/2003 Sugawara et al. ..... 438/240
6,587,021 B1 * 7/2003 Streeter ..... 333/262
6,686,820 B1 * 2/2004 Ma et al. ..... 333/262
6,689,976 B1 * 2/2004 Dove et al. ..... 200/182
2003/0162357 A1 * 8/2003 Sugawara et al. ..... 438/287
2003/0207102 A1 * 11/2003 Fong et al. ..... 428/328
2006/0046455 A1 * 3/2006 Nitta et al. ..... 438/597

* cited by examiner

*Primary Examiner*—Elvin Enad
*Assistant Examiner*—Bernard Rojas
(74) *Attorney, Agent, or Firm*—Weingarten, Schurgin, Gagnebin & Lebovici LLP

(57) ABSTRACT

Processes for preparing contacts on microswitches have been invented. The first is a wet process, involving the use of one or more acids, bases and peroxides, in some formulations diluted in water, to flush the contacts. The second process involves exposing the contacts to plasmas of various gases, including (1) oxygen, (2) a mixture of carbon tetrafluoride and oxygen, or (3) argon.

4 Claims, 8 Drawing Sheets

METHOD OF PREPARING ELECTRICAL CONTACTS USED IN SWITCHES

CROSS REFERENCE TO RELATED APPLICATIONS

This application claims priority from United States Provisional Patent Application Serial No. 60/200,306, filed Apr. 28, 2000, which is incorporated in its entirety herein.

STATEMENT REGARDING FEDERALLY SPONSORED RESEARCH OR DEVELOPMENT

N/A

BACKGROUND OF THE INVENTION

The invention relates to microswitches and microrelays and specifically to a method for preparing the contacts in these devices so that they work reliably for many (typically a billion or more) cycles.

The making and using of certain types of microswitches and microrelays is generally known. Micromechanical relays are receiving increased attention recently as our community begins to realize the benefits of integration of micromechanical structures with electronics. Development of these devices is being stimulated by a continuing need for small switches with very large ratios of off-impedance to on-impedance. Low on-state resistances are achieved by bringing two conductors into physical contact; high off-state impedances are a result of using small contact areas to minimize capacitance. Examples of such microfabricated switching devices employing electrostatic (P. M. Zavracky, S. Majumder, and N. E. McGruer, "Micromechanical Switches Fabricated Using Nickel Surface Micromachining," J. Microelectromechanical Systems, Vol. 6, 3-9 (1997); J. Drake, H. Jerman, B. Lutze and M. Stuber, "An electrostatically actuated micro-relay," Transducers '95 Eurosensors IX, Stockholm, Sweden (1995); M. Gretillat, P. Thiebaud, C. Linder and N. de Rooij, "Integrated circuit compatible electrostatic polysilicon microrelays," J. Micromech. Microeng. 5 156-60 (1995); K. E. Petersen, "Micromechanical membrane switches on silicon," IBM J. Res. Dev. 23 376-85 (1979); J. J. Yao and M. F. Chang, "A Surface Micromachined Miniature Switch for Telecommunications Applications with Signal Frequencies from DC up to 4 GHz," Proc. Transducers '95, Stockholm Sweden, vol. 2, pp384-387, 1995; K. Petersen, "Dynamic Micromechanics on Silicon: Techniques and Devices," IEEE Trans. On Electron Devices, vol. ED-25, pp. 1241-1250, 1978; J. Randall, C. Goldsmith, D. Denniston, and T-H. Lin, "Fabrication of Micromechanical Switches for Routing Radio Frequency Signals," J. Vac. Sci. Technol. B, vol. 14, p. 3692, 1996; M. A. Gretillat, P. Thieubaud, C. Linder, and N. F. de Rooij, J. Micromech. Microeng., vol 5, pp 156-160, 1995; J. Drake, H. Jerman, B. Lutze and M. Stuber, "An electrostatically actuated micro-relay," Transducers '95 Eurosensors IX, Stockholm, Sweden (1995); M. Sakata, "An electrostatic microactuator for electro-mechanical relay," Proc IEEE MEMS Workshop '89 (Salt Lake City, Utah) 149-51 (1989); S. Roy and M. Mehregany, "Fabrication of Electrostatic Nickel Microrelays by Nickel Surface Micromachining," Proc. IEEE Microelectromechanical Systems Workshop, Amsterdam, the Netherlands, pp. 353-357, 1995; and I. Schiele, J. Huber, C. Evers, B. Hillerich, and F. Kozlowski, "Micromechanical Relay with Electrostatic Actuation," Proc. Transducers '97, Chicago, vol. 2., p. 1165, 1997), magnetic (H. Hosaka, H. Kuwano, and K. Yanagisawa, "Electromagnetic Microrelays: Concepts and Fundamental Characteristics," Sensors and Actuators A, vol. 40, p. 41, 1994; and W. P. Taylor, M. G. Allen, and C. R. Dauwalter, "A Fully Integrated Magnetically Actuated Micromachined Relay," Proc. 1996 Solid State Sensor and Actuator Workshop, Hilton Head, pp. 231-234, 1996) and thermal (J. Simon, S. Saffer, and C. J. (CJ) Kim, J. Microelectromech. Sys., vol. 6, pp. 208-216, 1997; E. Hashimoto, H. Tanaka, Y. Suzuki, Y. Uenishi, and A. Watabe, "Thermally Controlled Magnetization Actuator for Microrelays," IEICE Trans. Electron., vol E80-C, p. 239, 1997; and J. Simon, S. Saffer, and Chang-Jin (CJ) Kim, "A Liquid-Filled Microrelay with a Moving Mercury Microdrop, J. Microelectromechanical Sys., Vol 6, p 208, 1997) actuation have been reported. The ideal actuation method would operate both at low power levels and at low voltages. In contrast to magnetic or thermally actuated devices, electrostatically actuated switches inherently operate at very low power levels, and are relatively simple to fabricate.

The microrelay performs a purely electronic function. We have fabricated two types of devices. The microrelay is a four terminal device as shown in FIG. 1*a*. Two terminals are used for actuation while the other two are switched. A second configuration is a three terminal device that we call a microswitch, shown in FIG. 1*b*. In either case, an electrostatic field applied between the beam (source) and the gate actuates the device. Switch closure shorts the beam tip to its counter electrode(s) thereby electrically connecting contacts a and b in the microrelay (or the source and drain in the microswitch). (The key difference between the microswitch and the microrelay in the terminology used herein is the presence or absence of electrical isolation between the actuator (the main part of the cantilever beam) and the contacts. This is independent of the number of contacts, and we have made switches with anywhere from 1 to at least 64 contacts.)

In previous publications, we have described the design, fabrication, and preliminary electrical characteristics of electrostatically-actuated, surface-micromachined, micromechanical switches and relays (P. M. Zavracky, et al., Microelectromechanical Systems, Ibid.; S. Majumder, P. M. Zavracky, N. E. McGruer, "Electrostatically Actuated Micromechanical Switches," *J. Vac. Sci. Tech. A*, vol. 15, p. 1246, 1997; S. Majumder, N. E. McCruer, P. M. Zavracky, G. G. Adams, R. H. Morrison, and J. Krim, "Measurement and Modeling of Surface Micromachined, Electrostatically Actuated, Microswitches," *International Conference on Solid-State Sensors and Actuators, Digest of Technical Papers*, Vol. 2, pp. 1145-1148, 1997; and S. Majumder, N. E. McGruer, P. M. Zavracky, R. H. Morrison, G. G. Adams, and J. Krim, "Contact Resistance Performance of Electrostatically Actuated Microswitches," *American Vacuum Society, 44th National Symposium* Abstracts, p. 161, 1997). An SEM micrograph of such a microswitch is shown in FIG. 2. (In FIG. 2 the contacts are part of the beam—not isolated—and so it is a microswitch.) These switches are capable of over $1\times10^9$ switching cycles at low currents (4 mA) and at least $1\times10^6$ switching cycles at 100 mA. The anchored end (source) is on the right, and the contacts are under the cantilever beam to the left of the center of the micrograph.

These devices typically have threshold voltages for contact closure of 50 to 60 V, although we have produced many switches with threshold voltages of 20 to 30 V and a few low-contact-force switches that have operated at voltages as low as 6 V. Switching times are a few microseconds and switch lifetimes can be in excess of $1\times10^9$ cycles.

The microrelay has obvious advantages over conventional relays in being smaller and consuming less power. However, what is most attractive is that the microrelay can be integrated with other devices on a single die. Micromachined relays can be fabricated in large numbers on a single die which may contain other electronic devices. The lack of high temperature steps in the fabrication process described here means that the relays can be included as post-process additions to a conventional integrated circuit. Complex switching arrays and devices designed to handle high frequency signals with low insertion loss are natural extensions of the work described here.

BRIEF SUMMARY OF THE INVENTION

Processes for preparing contacts on microswitches and microrelays have been invented. The first is a wet process, involving the use of one or more acids, bases and peroxides, in some formulations diluted in water, to flush the contacts. The second process involves exposing the contacts to plasmas of various gases, including (1) oxygen, (2) a mixture of carbon tetrafluoride and oxygen, or (3) argon.

DETAILED DESCRIPTION OF THE INVENTION

Figure 1A:
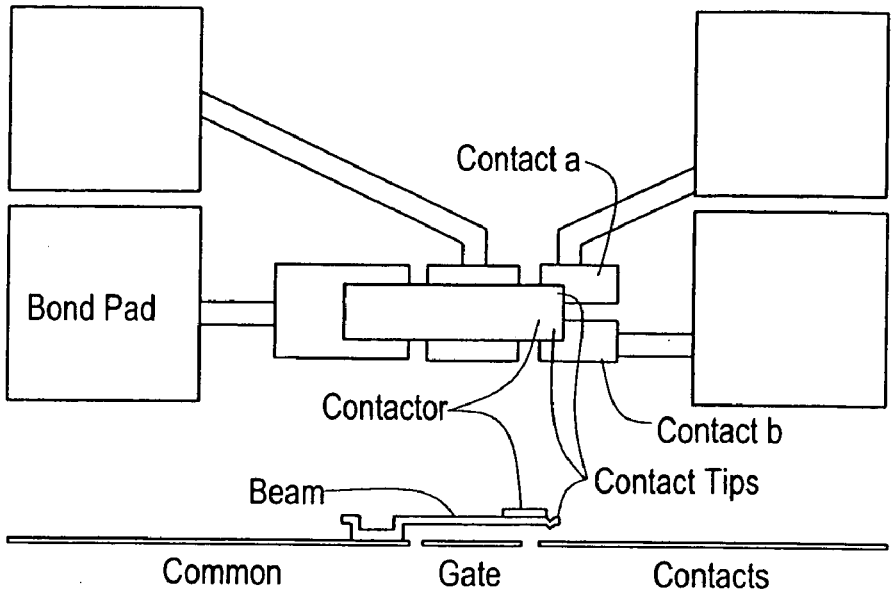
FIG. 1)*a*) A microrelay showing that the actuator is separated from the contacts by an insulating material. *b*) Schematic drawing of a microswitch showing the source, gate and drain. The dimple in the beam represents an indentation in the beam above the contact.
Figure 1B:
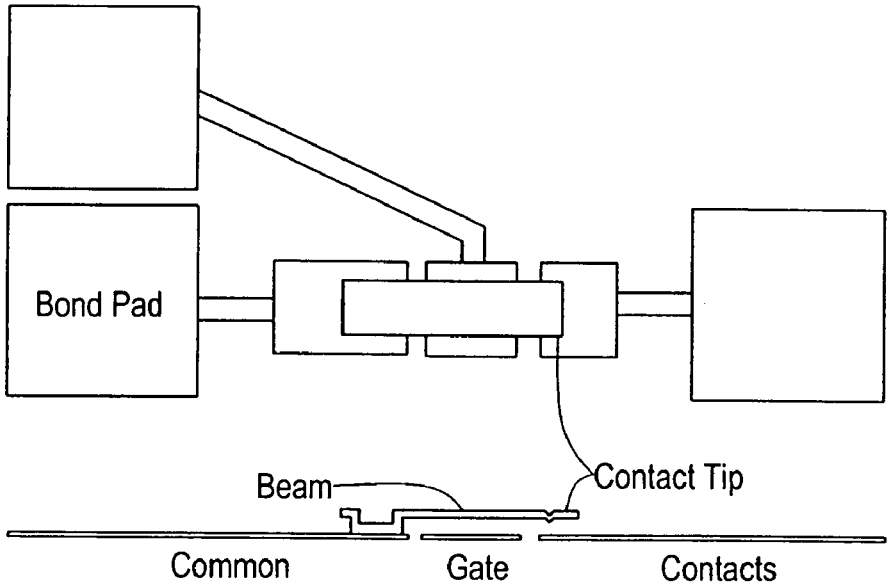
Figure 2:
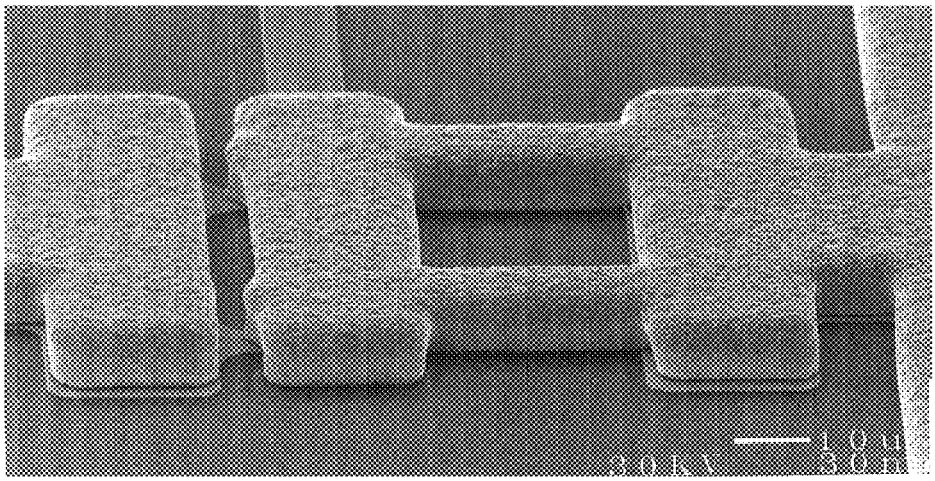
FIG. 2 is a scanning electron micrograph of a microswitch.
Figure 3A:
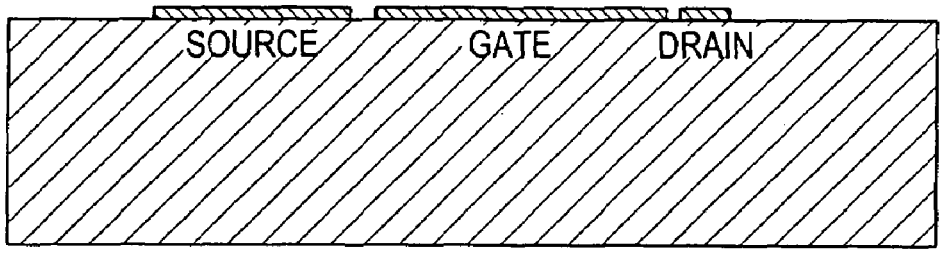
FIG. 3 shows a series of steps in the fabrication of a typical microswitch.
Figure 3B:
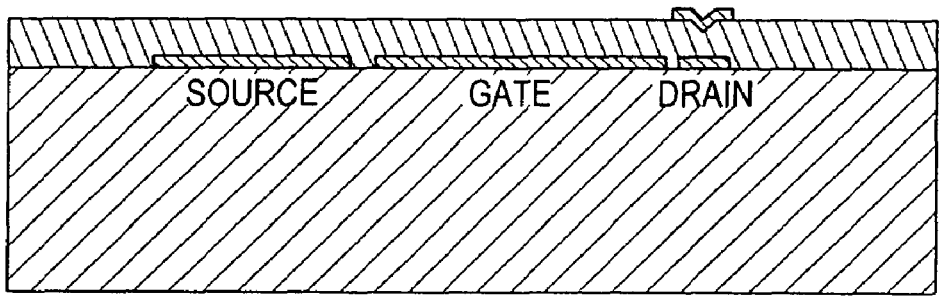
Figure 3C:
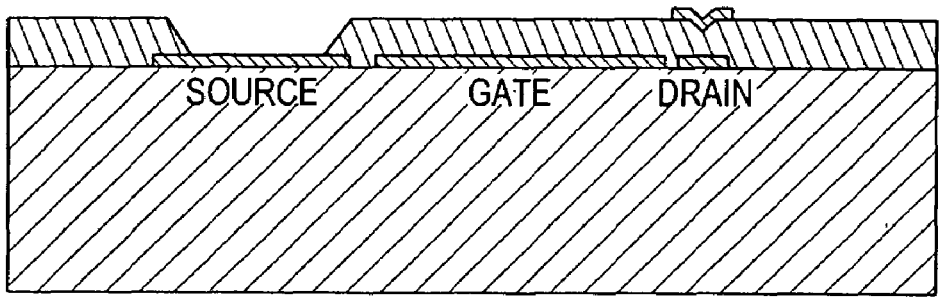
Figure 3D:
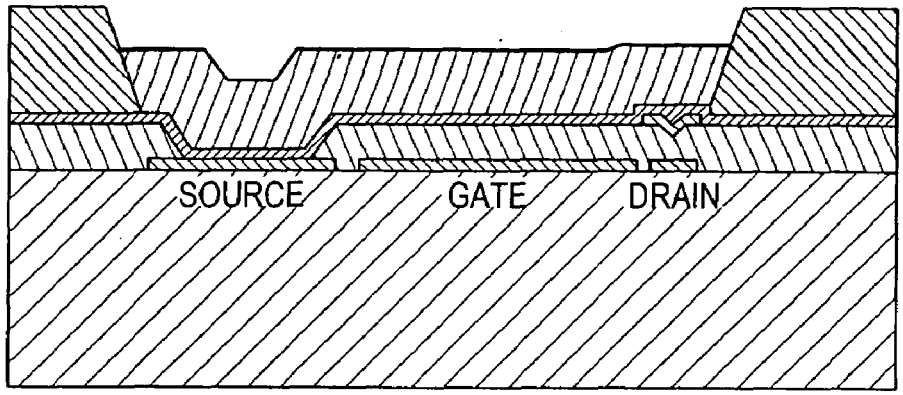
Figure 3E:
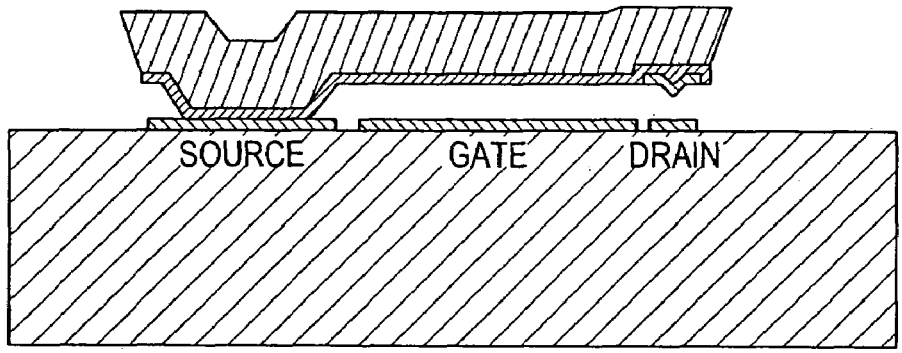

The processes invented herein are applicable to many different types of microswitches and microrelays. (Unless otherwise stated herein, what is stated for microswitches applies equally to microrelays and other similar devices.) The general requirement in these devices (also referred to as MEMS or microfabricated switches or relays) is that the contacts work at low force, over a large number of cycles, and with minimal scrubbing or lateral motion of the contact. In larger relays the lateral motion is sometimes designed in to remove surface contaminants.

The contacts can be made using gold (Au), ruthenium (Ru), rhodium (Rh), rhenium, osmium, iridium, platinum, palladium, any other materials related chemically or from a performance standpoint, and combinations and mixtures thereof. The preferred contacts are made from Au/Au, Au/Ru, Ru/Ru, Rh/Rh, Rh/Ru or Au/Rh, and the most preferred is Ru/Ru. (These pairs of elements indicate the material used on each of the surfaces that connect when the contact is made. For example, with Au/Ru, gold is used for the drain contact, while ruthenium is used for the beam contact.) (Note that the beam can be anything that is chemically compatible. Gold is used herein, in part because of processing considerations.)

Microswitches and microrelays are fabricated using standard integrated circuit (IC) processing techniques. All of the processes employed involve the deposition, patterning, and subsequent etching of layers added to an insulating substrate. There is no requirement to etch the substrate or otherwise alter its mechanical or electrical properties, thus the devices are true surface micromachined structures. The devices discussed herein were fabricated principally on Si substrates with a 1 μm thermal oxide; however, other substrates can be used so long as they provide sufficient isolation of the applied voltages and allow adequate adhesion of deposited metals. The processes for making microswitches and microrelays are identical other than the addition a one extra masking step for the insulator in the microrelays.

FIG. 3 illustrates a simplified view of the processing sequence for microswitches. A thin layer of Cr—Au or Ru, possibly with other adhesion layers, is sputter deposited on the substrate (typically 200 Å of chromium followed by 2000 Å of gold) and then photolithographically patterned to form the gate, source, and drain electrodes, bond pads, and associated interconnects. (Note: 2000 Å of Ru is typical for the Ru switches.) (See FIG. 3A) This is followed by deposition of a sacrificial layer, typically copper, which will ultimately determine the spacing between the gate electrode and beam. The sacrificial layer is patterned twice. The first patterning is used to define the contact tips which are then etched to a depth one third to one half of the sacrificial layer thickness. (See FIG. 3B) The contact tips are the smallest features in devices, typically 2 μm in diameter and less than 1 μm high. The second patterning defines the beam base via (or crevice), i.e. the points where the beam makes electrical contact to the source electrodes. (See FIG. 3C) The via is etched completely to expose the Cr—Au or Ru or other source electrode. The entire wafer is then patterned once more to define the beams. Gold is then deposited to form the contact surface followed by an electroplating step to build the beam to the desired thickness. (See FIG. 3D) Finally, the sacrificial layer is wet-etched to leave a freely supported, cantilever beam. (See FIG. 3E)

The process illustrated in FIG. 3 is a baseline. Additional masking steps can be added to selectively deposit metals at the contact areas. This facilitates optimizing contact metalization independent of beam materials. All of the processes are carried out at temperatures less than 200° C. Due to these low temperatures, switches and relays can be fabricated on substrates with active circuits underneath the insulating layer. Furthermore, the power levels required for sputtering are sufficiently low so as not induce radiation damage on conventional MOS (metal oxide semiconductor) or bipolar devices.

Once the microswitch is formed in the die, it is released from the die using the following process.

Exposure for approximately 5-20 minutes, preferably 15 minutes, to $H_2O_2$ (concentrated semiconductor grade; room temperature)

Rinse with deionized water for approximately 5-20 minutes (preferably 10 minutes)

Approximately 30-90 minutes treatment (preferably 60 minutes) using 25% Nitric Acid (concentrated semiconductor grade)/75% water (vol/vol) at room temperature up to 60 C (preferably 45 C)

Rinse with deionized water for approximately 5-20 minutes (preferably 10 minutes)

Exposure for approximately 5-20 minutes, preferably 15 Minutes, to $H_2O_2$ (concentrated semiconductor grade; room temperature)

Rinse with deionized water for approximately 5-20 minutes (preferably 10 minutes)

Dry with N2 gas

The die is then attached to the package and wire bonded to the external pins.

The preparation of the contacts is conducted as follows, using one of the following approaches.

(a) MF1 8:2 H2O2:NH4OH 20 Minutes

This approach exposes the contacts to the H2O2:NH4OH solution for approximately 5-30 minutes, preferably 20 minutes, by placing the packaged device in the solution and letting the solution flow over the contacts by either stirring or convection currents.

(b) MF12 6:4 NH4OH:H2O2 20 Minutes

This approach exposes the contacts to the NH4OH:H2O2 solution for 20 minutes by placing the packaged device in the solution and letting the solution flow over the contacts by either stirring or convection currents.

(c) ICP Clean 300 w 3 minutes 5 mTorr O2 flow=100 sccm, (ICP means Inductively Coupled Plasma); other gases can be used, such as carbon tetrafluoride, sulfur hexafluoride or other fluorine containing gases, or argon.

In the preferred embodiment, this approach exposes the contacts to inductively coupled oxygen plasma at 300 watt power for 3 minutes at 5 millitorr. Specifically, switches or relays are placed in a vacuum chamber that is evacuated to a pressure of less than $10^{-4}$ Torr. The chamber is then refilled with flowing gas (oxygen, argon, etc.) to maintain a pressure of 0.001-1 Torr. Radio frequency electrical energy (50 kHz-100 MHz) is coupled into the gas by means of an electrical coil. The electrical energy ionizes the gas to produce free electrons, ions, electronically excited atoms and molecules, and molecular fragments. These highly reactive gaseous species diffuse within the switch's microstructure and react with the contact surfaces. In this way the contact surfaces are modified to lower the contact resistance of the device. Those familiar with the art of plasma processing will recognize that rather than inductively coupled plasma, one may also use other commonly practiced plasma technologies such as microwave plasma, DC plasma, radio frequency capacitively coupled plasma and electron cyclotron resonance plasma.

Other fluids (either liquids or gases) for preparing the contacts are possible. For example, the following solutions have been successfully used:

SOLUTIONS USED FOR CONTACT PREPARATION

| Solution | Ratio Components | Components | Particularly good on |
|---|---|---|---|
| MF1 | 8:2 | $H_2O$:$NH_4OH$ | Au/Au |
| MF2 | 8:2 | $H_2O$:HCl | |
| MF3 | 5:1:05 | $H_2O$:$H_2O_2$:$NH_4OH$ | |
| MF4 | 5:1:1 | $H_2O$:$H_2O_2$:HCl | |
| MF5 | 10:1 | $H_2O$:$NH_4OH$ | |
| MF6 | 6:2 | $H_2O$:$NH_4OH$ | |
| MF7 | 2:1 | $H_2SO_4$:$H_2O_2$ | |
| MF8 | 6:4 | $NH_4OH$:$H_2O$ | |
| MF9 | 8:2 | $NH_4OH$:$H_2O$ | |
| MF10 | 100% | $NH_4OH$ | |
| MF11 | 3:1 | $H_2O$:TMAH | |
| MF12 | 6:4 | $H_2O$:$NH_4OH$ | Au/Ru or Ru/Ru |

-continued

SOLUTIONS USED FOR CONTACT PREPARATION

| Solution | Ratio Components | Components | Particularly good on |
|---|---|---|---|
| MF13 | 3:1 | $H_2O$:CITRIC ACID | |
| ICP (1) | | | Ru/Ru |
| ICP (2) | | | Au/Au |

(1) Inductively coupled plasma (ICP), using oxygen or CF4/oxygen or Ar gases, with pressure ranging from approximately 1 MilliTorr to approximately 1 Torr or more, preferably approximately 50-200 MilliTorr.

(2) ICP using oxygen gas at pressure from approximately $10^{-4}$ Torr to 1000 Torr, but preferably 1-50 MilliTorr.

Other mixtures of sulfuric acid, hydrogen peroxide, ammonium hydroxide and hydrochloric acid, preferably diluted with water, have been used for preparing the contacts using the novel process.

Once the cleaning was complete, the contacts were tested, using the following method:

Actuation voltage applied, approximately 1.5× Threshold Voltage

Drain Current Applied

Drain resistance measured

Drain Current disconnected

Actuation voltage disconnected

Above cycles repeated from 1e6 to 1e9 times

In more detail, the procedure is as follows: The cantilever beam is held at ground potential. A first voltage source is connected to the actuator or gate electrode. A second voltage source is connected, in series with a 50 Ohm resistor, to the drain electrode. The current supplied by both voltage sources is measured. The voltage across the microswitch or microrelay contacts is also measured. All measurements are typically under computer control to perform the very large number of tests that may be required for each switch (more than $10^{11}$ test cycles may be required).

The second voltage source is set to 0.2 V (for tests at approximately 4 mA). The voltage of the first source is increased until current begins to flow through the switch. This establishes the threshold voltage. The switch may either be tested at some multiple of this threshold voltage (for example 1.3 times the threshold voltage), or all the switches on a wafer may be tested at some predetermined voltage. Either of these methods determines the test actuation voltage for the test (the voltage of the first source during subsequent testing).

The test procedure for a single switch is as follows: The voltage of the first source is set to zero, then the voltage of the second source is set to 0.2V. The current from the second source is checked to make certain it is zero, indicating that the switch has indeed opened. The voltage of the second source is reset to zero. Next, the voltage of the first source is set to the test actuation voltage, the voltage of the second source is again set to 0.2 V, and the voltage across the switch contacts is measured. From this voltage and the known parameters of the system, the resistance of the switch can be determined. Finally, the voltage of the second source is set to zero again and the voltage of the first source is set to zero.

This procedure is repeated as many times as desired, recording test data for some or all of the switching cycles.

The microrelay test procedure is the same except that one of the two microrelay contacts is held at ground potential and the second microrelay contact is connected to the second voltage source.

Figure 4A:
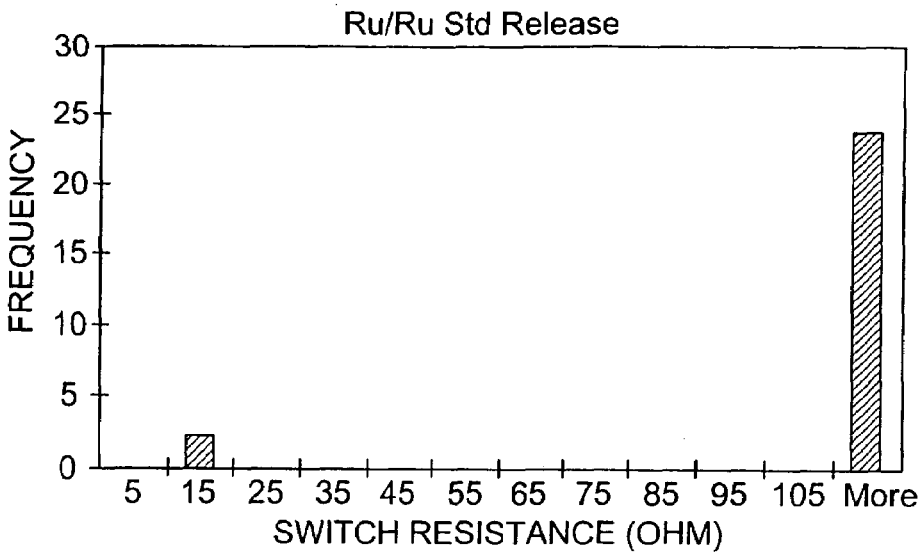
FIG. 4 shows test results for contacts before and after treatment, respectively, for Ru/Ru (Figs. A and B), Ru/Au (Figs. C, D and E; Note that D and E represent data after preparation of contacts) and Au/Au (Figs. F and G).
Figure 4B:
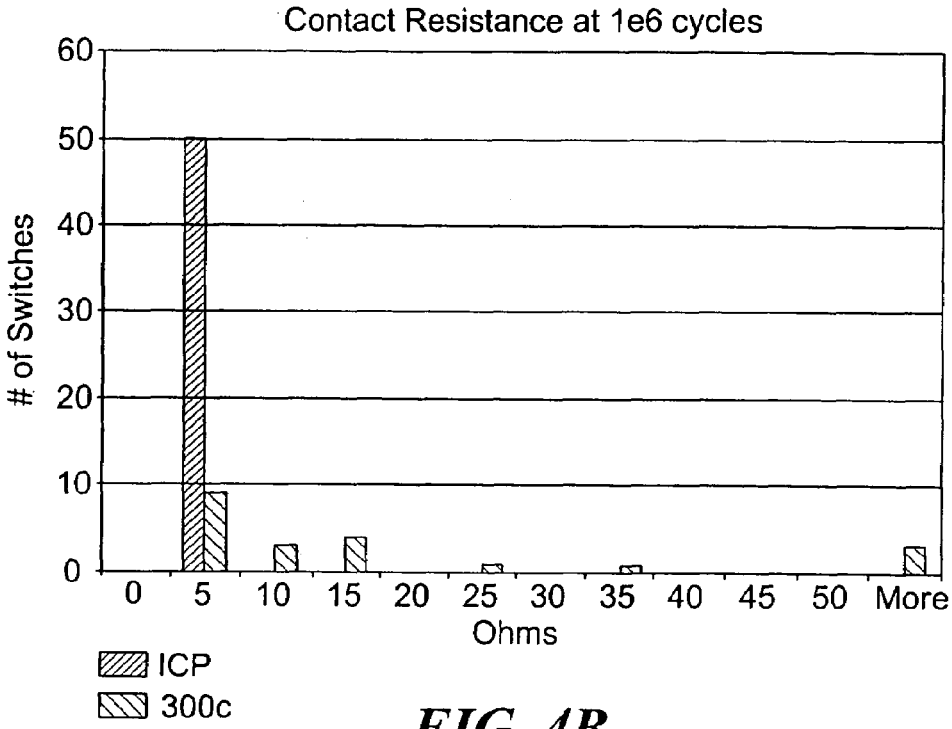
Figure 4C:
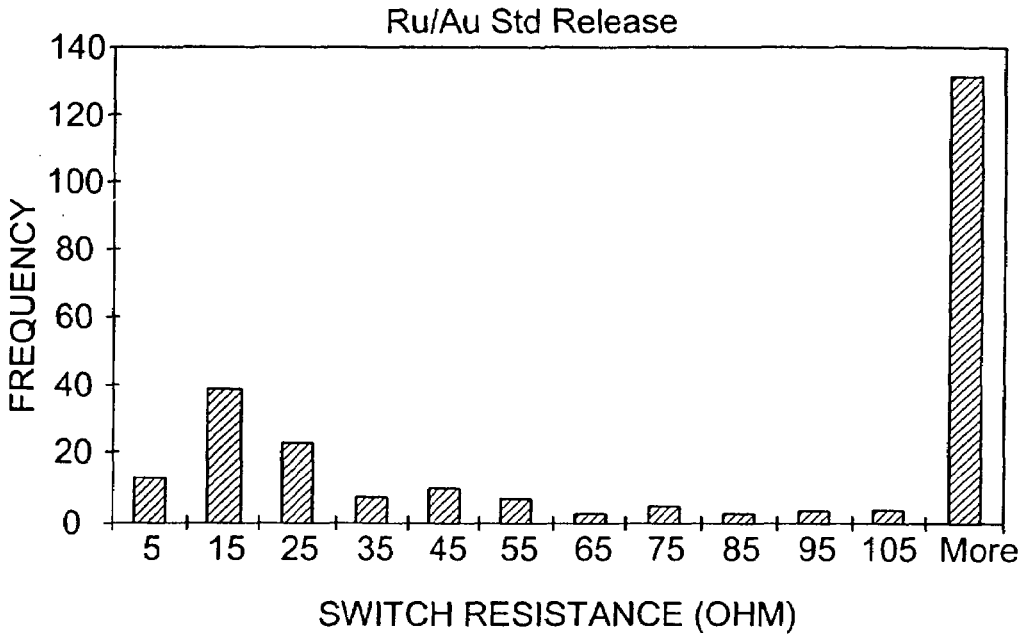
Figure 4D:
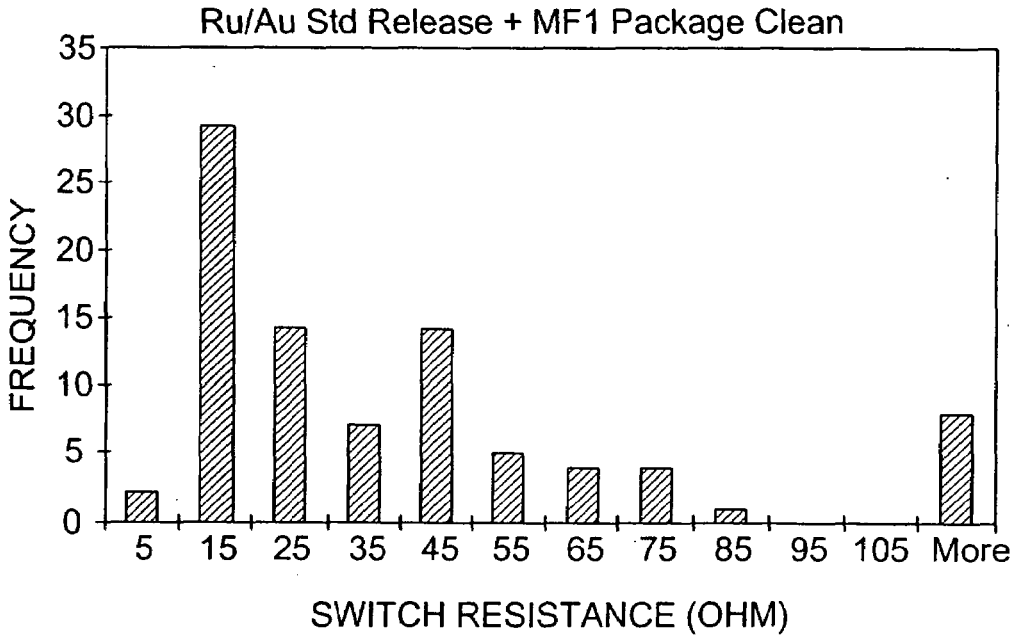
Figure 4E:
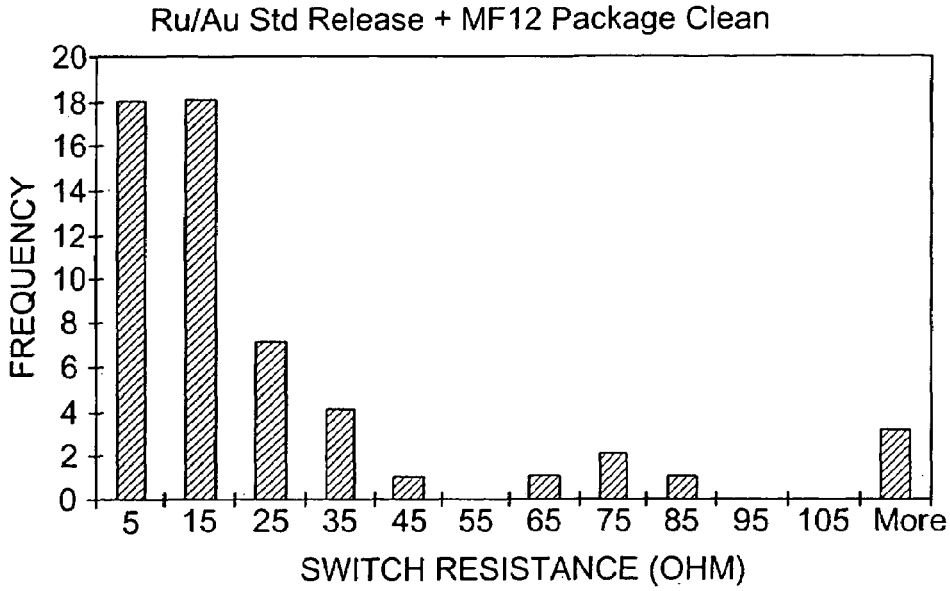
Figure 4F:
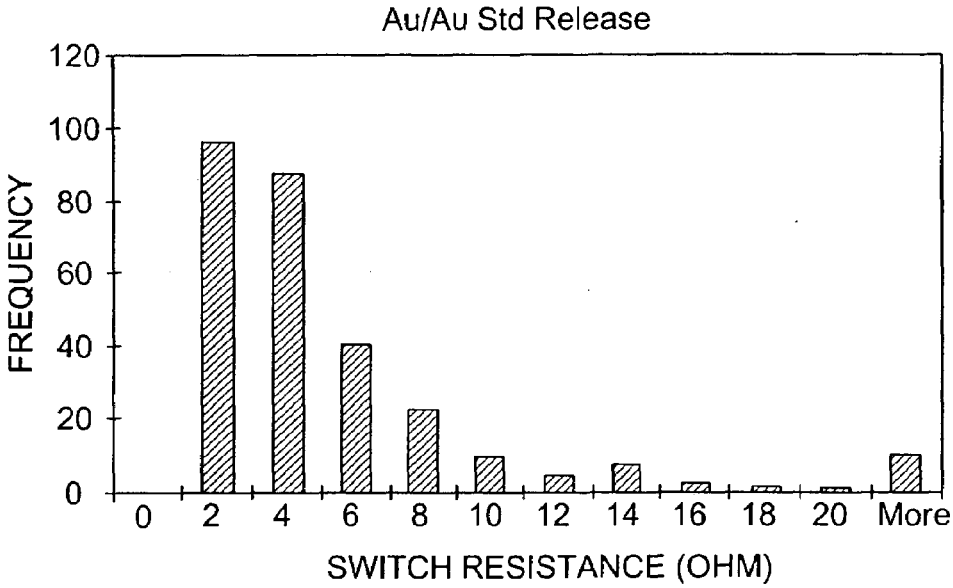
Figure 4G:
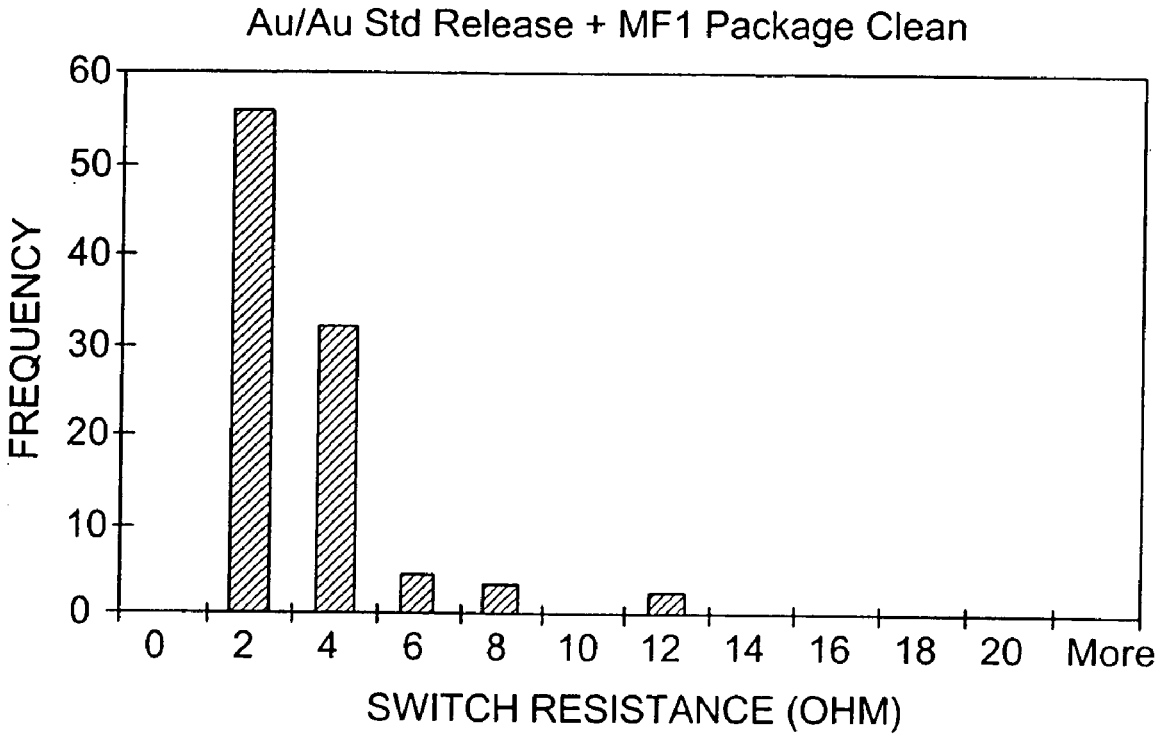

The testing showed that the novel procedure prepared contacts that were suitable for long usage periods. See the data summarized in FIG. 4, where a number of contacts were tested for switch resistance (in ohms), and the number of microswitches having a given resistance was tabulated. As can be seen, for example, with the Ru/Ru microswitches, using the standard release, (Note: Previously there was no cleaning/preparation method for the contacts. This is referred to as "Std release",) 2 switches had 15 ohm resistance and 25 had >105 ohm resistance. (See FIG. 4A) However, after preparation of the contacts using the novel process, all 50 tested had 4 ohms (using ICP for cleaning). Using an anneal in a furnace tube at 300 C, 200 sccm flowing $N_2$, for 60 minutes, 9 switches had 5 ohm resistance, 10 had 3, 4 had 15, etc. (See FIG. 4B) Thus, preparation of contacts using the novel procedure yielded contacts with considerably lower resistance.

Low resistance after many cycles of usage (approximately a million or more cycles) was also found with contacts prepared using the novel process.

It will be apparent to those skilled in the art that other modifications to and variations of the above-described techniques are possible without departing from the inventive concepts disclosed herein. Accordingly, the invention should be viewed as limited solely by the scope and spirit of the appended claims.

What is claimed is:

1. A process for manufacturing a contact on a microswitch prior to operation of the microswitch, the process providing a reduced resistance for the microswitch that is maintainable for many cycles when the microswitch is operated, comprising:

a. forming the microswitch contact with a predetermined material;

b. exposing the microswitch contact to a fluid that operates in conjunction with the predetermined material to lower a contact resistance, the exposure to the fluid being over an interval that ends prior to operation of the microswitch; and wherein the fluid comprises materials selected from the group consisting of oxygen, carbon tetrafluoride, sulfur hexafluoride or other fluorine-containing gases, argon and mixtures thereof.

2. The process of claim 1 wherein the fluid is a gaseous plasma.

3. The process of claim 1 wherein the plasma is Inductively Coupled Plasma.

4. A semiconductor package having a semiconductor die connected to external pins, the die including an active area;

a microswitch formed on a surface of the die, wherein a microswitch contact is formed with a process for reducing a resistance of the microswitch and maintaining a low resistance of the microswitch for many cycles, comprising:

a. forming the microswitch contact with a predetermined material;

b. temporarily exposing the microswitch contact to a fluid that operates in conjunction with the predetermined material to lower a contact resistance.

* * * * *

UNITED STATES PATENT AND TRADEMARK OFFICE

CERTIFICATE OF CORRECTION

PATENT NO. : 7,256,669 B2
APPLICATION NO. : 09/844251
DATED : August 14, 2007
INVENTOR(S) : Richard H. Morrison, Jr. et al.

It is certified that error appears in the above-identified patent and that said Letters Patent is hereby corrected as shown below:

Column 2, line 45, “McCruer” should read --McGruer--; and

Column 8, claim 3, line 17, “process of claim 1” should read --process of claim 2--.

Signed and Sealed this

First Day of January, 2008

JON W. DUDAS
*Director of the United States Patent and Trademark Office*

UNITED STATES PATENT AND TRADEMARK OFFICE

Certificate

Patent No. 7,256,669 B2 Patented: August 14, 2007

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Richard H. Morrison, Jr., Taunton, MA (US); Nicol E. McGruer, Dover, MA (US); Jeffrey A. Hopwood, Needham, MA (US); and Mark Schirmer, Stoughton, MA (US).

Signed and Sealed this Fifth Day of August 2008.

ELVIN G. ENAD
*Supervisory Patent Examiner*
Art Unit 2832